United States Patent [19]

McKenzie

[11] Patent Number: 5,076,867

[45] Date of Patent: Dec. 31, 1991

[54] STABILIZED EMULSION EXPLOSIVE AND METHOD

[76] Inventor: Lee F. McKenzie, 15090 Rose Canyon Rd., Riverton, Utah 84065

[21] Appl. No.: 615,289

[22] Filed: Nov. 19, 1990

[51] Int. Cl.[5] ..... C06G 45/00

[52] U.S. Cl. ..... 149/2; 149/5; 149/21; 149/46; 149/60; 149/109.6

[58] Field of Search ..... 149/2, 21, 46, 60, 109.6, 149/5

[56] References Cited

U.S. PATENT DOCUMENTS

| | | | |
|---|---|---|---|
| 4,830,687 | 5/1989 | Mullay et al. | 149/2 |
| 4,907,368 | 3/1990 | Mullay et al. | 149/2 |
| 4,960,475 | 10/1990 | Cranney et al. | 149/2 |

*Primary Examiner*—Stephen J. Lechert, Jr.

[57] ABSTRACT

The invention relates to a method for stabilizing a detonable mixture of emulsion and AN or ANFO prills and to the resulting compositions. A surfactant is dissolved in a liquid organic fuel prior to adding the fuel to AN prills for forming ANFO prills, or if AN prills are used without added liquid organic fuel, the surfactant is added to the prills. The ANFO prills or AN prills containing a surfactant than are mixed with the emulsion.

20 Claims, No Drawings

STABILIZED EMULSION EXPLOSIVE AND METHOD

The present invention relates to an improved explosive composition. More particularly, the invention relates to explosives containing "water-in-oil" emulsions and ammonium nitrate (AN) and ANFO prills. The term "water-in-oil" means a dispersion of droplets of an aqueous solution or water-miscible melt (the discontinuous phase) in an oil or water-immiscible organic substance (the continuous phase). The term "emulsion" hereafter shall refer to a water-in-oil emulsion. The term "explosive" means both cap-sensitive explosives and non cap-sensitive explosives commonly referred to as blasting agents.

The water-in-oil emulsion explosives of this invention contain a water-immiscible organic fuel as the continuous phase and an emulsified inorganic oxidizer salt solution or melt as the discontinuous phase. (The terms "solution" or "melt" hereafter shall be used interchangeably.) Added to and mixed uniformly throughout this emulsion are AN prills or AN prills in the form of ANFO, a mixture of generally about 94% ammonium nitrate prills and about 6% of an organic liquid hydrocarbon fuel. The resulting ANFO mixture will be referred to herein as ANFO prills.

The present invention is based on the addition of a surfactant to the AN prills or the dissolution of a surfactant in the liquid organic fuel of the ANFO prills prior to the addition of the liquid fuel to the ammonium nitrate prills. It has been found that the use of a surfactant in this manner imparts greatly increased stability to the resulting emulsion and AN or ANFO prills mixture. By "stability" is meant that the emulsion phase of the emulsion and AN or ANFO prills mixture remains a stable emulsion, i.e., does not appreciably break down or experience crystallization of the discontinuous oxidizer salt phase over a given period of time.

BACKGROUND OF THE INVENTION

Emulsion explosives are well-known in the art. See, for example, U.S. Pat. Nos. 4,356,044; 4,322,258; 4,141,767; 3,447,978 and 3,161,551. Emulsion explosives comprising an emulsion phase blended with ammonium nitrate (AN) prills and/or ANFO prills also are well-known in the art. See, for example, U.S. Pat. Nos. 4,294,633 and 3,161,551.

An inherent problem with emulsion explosives, however, and particularly with emulsion and prill mixtures, is their relative instability, due to the fact that they comprise a thermodynamically unstable dispersion of supercooled solution or melt droplets in an oil-continuous phase. If the emulsion remains stable, the supercooled droplets are prevented from crystallizing or solidifying into a lower energy state. If the emulsion weakens or becomes unstable, however, then crystallization or solidification of the droplets results, and the explosive generally loses at least some of its sensitivity to detonation and becomes too viscous to handle for certain blasting applications. Moreover, when solid components are added to emulsion explosives, such as glass microspheres for density reduction or prills or particles of oxidizer salt or ANFO for increased energy, such solid components tend to destabilize emulsions even further. The solid components may disrupt the continuous fuel phase and provide a site for resulting crystallization of the discontinuous oxidizer salt solution phase. In addition, the prills often contain fines and/or a clay or talc coating that act as poisons to the emulsion thereby hastening its destabilization. Since emulsion and prill combinations must remain stable during handling and for a period of time after being loaded into a borehole in order to remain reliably detonable, the presence of AN or ANFO prills can present serious stability problems.

It has been found in the present invention that if the liquid fuel component of the ANFO prills contains a dissolved surfactant of the types hereafter described, or if such a surfactant is added to AN prills, the stability of the resulting emulsion and AN or ANFO prills mixture is greatly enhanced over a similar mixture not containing a surfactant so dissolved in the fuel portion or added to the AN prills. For optimum performance, the selection of a surfactant can be based on the type of AN prill and coatings involved as well as the type of emulsifier system used.

SUMMARY OF THE INVENTION

The invention relates to a method for stabilizing a detonable mixture of emulsion and AN or ANFO prills. If the mixture involves ANFO prills, the steps comprise dissolving a surfactant in a liquid organic fuel prior to adding the fuel to AN prills, adding the fuel containing the dissolved surfactant to the AN prills to form ANFO prills and blending the ANFO prills with an emulsion to form a stable explosive composition. If AN prills are used, the steps include adding the surfactant to the prills and then mixing them with the emulsion. The compositions of the invention comprise stabilized emulsion explosives having a mixture of AN or ANFO prills and emulsion wherein the AN prills contain a surfactant and the ANFO prills comprise a mixture of AN prills and a liquid organic fuel in which a surfactant is dissolved.

DETAILED DESCRIPTION OF THE INVENTION

The AN prills can be any of those used in the industry for manufacturing explosives. Typically, they are porous, low density prills that enhance the sensitivity of the explosive composition by contributing air voids or pockets to the composition. Ground or high density prills, however, also can be used. AN prills generally have a surface coating to retard caking due to their hydroscopicity. The types of coating are inorganic parting agents, such as talcs and clays, and organic crystal habit modifiers, such as alkylnapthalene sulfonates. As stated above, certain coatings are found to destabilize or poison an emulsion. The use of the surfactant in accordance with the invention greatly enhances stability of the emulsion/prill mixture even when the prills contain the destabilizing coatings.

The surfactant can be selected from the group consisting of lecithin; phosphatidylethanolamine, phosphatidylinositol and phosphatidylcholine derivatives; esters; amides; imides; carboxylates; amines; polyamines; alcohols; polyols; ethers and combinations thereof. Thus the surfactants can be amphoteric, cationic, non-ionic and anionic. A preferred surfactant is lecithin. Natural fluid lecithin is most commonly derived from soybean plants and consists of a mixture of organic materials including soybean oil and phosphatidylcholine, phosphatidylethanolamine and phosphatidylinositol derivatives. Lecithin generally is considered an amphoteric surfactant since it has both negative and positive functional groups. The negative charge comes from underivatized sites on phosphate groups, while the positive charge comes from quantenary amines or protonated primary amines.

Other preferred surfactants are polyamine derivatives (such as polyethylene polyamine) of polyisobutenyl phenol. This surfactant is cationic in the presence of ammonium ions.

Another preferred class of surfactants are derivatives of polyisobutenyl succinic anhydride (PIBSA) and alkanolamines. One such surfactant is a 2:1 derivative of trishydroxymethylaminomethane and PIBSA. Although this surfactant is a mixture of ester, imide, amide and oxazoline derivatives, the majority of surfactant molecules are noinonic in nature.

The surfactant can be added directly to the AN prills, such as by spraying, in trace amounts up to 5% or more by weight of the prills. It also can be added to the fuel portion of ANFO prills. The fuel portion of the ANFO prills is comprised of those immiscible organic fuels described below. Prior to adding the fuel to the AN prills, the surfactant is dissolved in the organic fuel in an amount of from about 2% to about 100% b weight of the organic fuel. This fuel solution then is added to the AN prills generally in an amount of about 2% to about 10% by weight of the ANFO prills. The ANFO prills then may be added to the emulsion to form the emulsion explosive composition. The amount of the emulsion can vary from about 10% to about 90% by weight of the total composition, and the ANFO prills from about 90% to about 10%.

The immiscible organic fuel forming the continuous phase of the emulsion is present in an amount of from about 3% to about 15%, and preferably in an amount of from about 4% to about 8% by weight of the emulsion. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cotton seed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

The emulsifiers can be selected from those conventionally employed and are used generally in an amount of from about 0.2% to about 5%. Typical emulsifiers include sorbitan fatty esters, glycerol esters, substituted oxazolines, alkylamines or their salts, derivatives thereof and the like. More recently, certain polymeric emulsifiers, such as a bis-alkanolamine or bis-polyol derivative of a bis-carboxylated or anhydride derivatized olefinic or vinyl addition polymer, have been found to impart better stability to emulsions under certain conditions.

In addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% b weight.

The inorganic oxidizer salt solution forming the discontinuous phase of the emulsion generally comprises inorganic oxidizer salt, in an amount from about 45% to about 95% by weight of the emulsion, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred.

Water preferably is employed in amounts of from about 1% to about 30% by weight of the emulsion. It is commonly employed in emulsions in an amount of from about 9% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels can include urea, alcohols such as sugars and methyl alcohol, glycols such as ethylene glycols, amides such as formamide, amines, amine nitrates, and analogous nitrogen-containing fuels. As is well known in the art, the amount and type of water-miscible liquid(s) or solid(s) used can vary according to desired physical properties.

Chemical gassing agents preferably comprise sodium nitrite, that reacts chemically in the composition to produce gas bubbles, and a gassing accelerator such as thiourea, to accelerate the decomposition process. A sodium nitrite/thiourea combination begins producing gas bubbles immediately upon addition of the nitrite to the oxidizer solution containing the thiourea, which solution preferably has a pH of about 4.5. The nitrite is added as a diluted aqueous solution in an amount of from less than 0.1% to about 0.4% by weight, and the thiourea or other accelerator is added in a similar amount to the oxidizer solution. In addition to or in lieu of chemical gassing agents, hollow spheres or particles made from glass, plastic or perlite may be added to provide density reduction. These solid density control agents also can effect the stability of emulsion explosives of the type of the present invention. It has been found that certain surfactants function better with a particular solid density control agent.

The emulsion of the present invention may be formulated in a conventional manner. Typically, the oxidizer salt(s) and other aqueous soluble constituents first are dissolved in the water (or aqueous solution of water and miscible liquid fuel) at an elevated temperature of from about 25° C. to about 90° C. or higher, depending upon the crystallization temperature of the salt solution. The aqueous solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. When gassing is desired, which could be immediately after the emulsion is formed or up to several months thereafter when it has cooled to ambient or lower temperatures, the gassing agent and other advantageous trace additives are added and mixed homogeneously throughout the emulsion to produce uniform gassing at the desired rate. The solid ingredients, if any, can be added along with the gassing agent and/or trace additives and stirred throughout the formulation by conventional means. Packaging and/or further handling should quickly follow the addition of the gassing agent, depending upon the gassing rate, to prevent loss or coalescence of gas bubbles. The formulation process also can be accomplished in a continuous manner as is known in the art.

It is advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

Once the emulsion is formed, the AN prills, to which a surfactant has been added, or the ANFO prills, which comprise AN prills and liquid organic fuel in which a surfactant has been dissolved, then are added to the emulsion and mixed uniformly throughout by conventional means.

Reference to the following Table further illustrates this invention. Mixes 1, 3, 5, and 7 do not contain a surfactant "stabilizer" of the invention, whereas corresponding mixes 2, 4, 6 and 8, respectively, do. By comparing the detonation results between mixes 1 and 2, 3 and 4, and so on, the stabilizing effect of the surfactant is readily apparent.

While the present invention has been described with reference to certain illustrative examples and preferred embodiments, various modifications will be apparent to those skilled in the art and any such modifications are intended to be within the scope of the invention as set forth in the appended claims.

TABLE

| | 1 | 2 | 3 | 4 | 5 | 6 | 7 | 8 |
|---|---|---|---|---|---|---|---|---|
| Ingredients | | | | | | | | |
| AN | 44.50 | 44.50 | 44.50 | 44.50 | 37.20 | 37.20 | 37.20 | 37.20 |
| $H_2O$ | 11.12 | 11.12 | 11.12 | 11.12 | 9.30. | 9.30 | 9.30 | 9.30 |
| #2 FO | 2.16 | 2.16 | 2.16 | 2.16 | 1.79 | 1.79 | 1.79 | 1.79 |
| Mineral Oil | 0.72 | 0.72 | 0.72 | 0.72 | 0.65 | 0.65 | 0.65 | 0.65 |
| Emulsifier | | | | | | | | |
| (a) (see key below) | 0.72 | 0.72 | 0.72 | 0.72 | | | | |
| (b) | | | | | 0.81 | 0.81 | 0.81 | 0.81 |
| Density Control | | | | | | | | |
| (c) | 0.78 | 0.78 | 0.78 | 0.78 | | | | |
| (d) | | | | | 0.25 | 0.25 | 0.25 | 0.25 |
| ANFO | | | | | | | | |
| AN (e) | 37.60 | 37.60 | | | 47.00 | 47.00 | | |
| AN (f) | | | 37.60 | 37.60 | | | | |
| AN (g) | | | | | | | 47.00 | 47.00 |
| FO | 2.40 | 2.16 | 2.40 | 2.16 | 3.00 | 2.55 | 3.00 | 2.55 |
| Stabilizer | | | | | | | | |
| (h) | | 0.24 | | 0.24 | | | | |
| (i) | | | | | | 0.45 | | 0.45 |
| Density (g/cc) | 1.36 | 1.36 | 1.36 | 1.36 | 1.28 | 1.28 | 1.28 | 1.28 |
| Storage Temperature (°C.) | 5° C. | 5° C. | 5° C. | 5° C. | 5° C. | 5° C. | 5° C. | 5° C. |
| Detonation Results at 5° C. | | | | | | | | |
| 1 Day | | | | | | | | |
| D, 125 mm (km/sec) | 4.54 | 5.08 | 4.54 | 4.70 | 5.40 | 5.08 | 4.89 | 5.18 |
| MB, 125 mm (Det/Fail) | 18 g/9 g | 18 g/9 | 50 g/18 g | 50 g/18 g | 18 g/9 g | 18 g/9 g | 18 g/9 g | 18 g/9 g |
| $d_c$, Det/Fail (mm) | 75/63 | 75/63 | 75/63 | 100/75 | 75/ | 75/ | 75/ | 75/ |
| 1 Week | | | | | | | | |
| D, 125 mm (km/sec) | 3.63 | 4.23 | Fail | 4.38 | 4.89 | 4.89 | 4.70 | 4.79 |
| MB, 125 mm (Det/Fail) | 50 g/18 g | 18 g/9 g | —/3 C | 50 g/18 g | 50 g/18 g | 18 g/ | 50 g/18 | 50 g/18 g |
| $d_c$, Det/Fail (mm) | 125/100 | 100/75 | —/125 | 100/75 | 75/ | 75/ | 125/100 | 100/75 |
| 2 Weeks | | | | | | | | |
| D, 125 mm (km/sec) | Fail | 4.30 | — | 3.85 | 5.08 | 4.89 | 4.70 | 4.89 |
| MB, 125 mm (Det/Fail) | —/3 C | 18 g/9 g | —/— | 50 g/18 g | 50/ | 18/ | 50/ | 50/ |
| $d_c$, Det/Fail (mm) | —/125 | 100/75 | —/— | 100/75 | 100/75 | 75/ | 125/ | 100/ |
| 3 Weeks | | | | | | | | |
| D, 125 mm (km/sec) | | | | | 4.89 | 4.98 | 4.70 | 4.70 |
| MB, 125 mm (Det/Fail) | | | | | 50/ | 18/ | 90/50 | 50/ |
| $d_c$, Det/Fail (mm) | | | | | 100/ | 75/ | 150/125 | 100/ |
| 4 Weeks | | | | | | | | |
| D, 125 mm (km/sec) | — | 3.97 | — | 4.10 | | | | |
| MB, 125 mm (Det/Fail) | —/— | 50 g/18 g | —/— | 50 g/18 g | | | | |
| $d_c$, Det/Fail (mm) | —/— | 125/100 | —/— | 125/100 | | | | |

(a) Sorbitan monooleate.
(b) A polymeric emulsifier as described in U.S. Pat. No. 4,931,110.
(c) Glass microballoons from 3M Company.
(d) Organic microballoons from Expancel Company.
(e) Ammonium nitrate prill with a talc/Petro AG coating.
(f) Ammonium nitrate prill with a clay coating.
(g) Ammonium nitrate prill containing both internal and external surfactants which are known emulsion poisons.
(h) Liquid soya lecithin.
(i) Imide derivative of PIBSA and a polyethylene polyamine.

What is claimed is:

1. A method for stabilizing a detonable mixture of emulsion and ANFO prills comprising the steps of dissolving a surfactant in a liquid organic fuel prior to adding the fuel to ammonium nitrate prills, adding the fuel containing the dissolved surfactant to the ammonium nitrate prills to form ANFO prills and blending the ANFO prills with an emulsion to form a stable explosive composition.

2. A method according to claim 1 wherein the surfactant is selected from the group consisting of lecithin; phosphatidylcholine, phosphatidylethanolamine and phosphatidylinositol derivatives; esters; amides; imides; carboxylates; amines; polyamines; alcohols; polyols; ethers and combinations thereof.

3. A method according to claim 1 wherein the liquid organic fuel is selected from the group consisting of tall oil, mineral oil, waxes, benzene, toluene, xylene, petroleum distillates.

4. A method according to claim 3 wherein the liquid hydrocarbon fuel is No. 2 fuel oil.

5. A method according to claim 1 wherein the ammonium nitrate prills contain a clay or talc coating.

6. A method according to claim 1 wherein the emulsion comprises an organic fuel as a continuous phase, an emulsified inorganic oxidizer salt solution or melt as a discontinuous phase, an emulsifier, and optionally, a density reducing agent.

7. A method according to claim 6 wherein the emulsifier is selected from the group consisting of a bis-alkanol amine or bis-polyol derivative of a bis-carboxylated or anhydride derivatized olefinic or vinyl addition polymer, sorbitan fatty esters, glycerol esters, substituted oxazolines, alkylamines or their salts, and derivatives thereof.

8. A method according to claim 6 wherein the surfactant is lecithin.

9. A method for stabilizing a detonable mixture of emulsion and AN prills comprising the steps of adding a surfactant to the ammonium nitrate prills and blending the ammonium nitrate prills with an emulsion to form a stable explosive composition.

10. A stabilized emulsion explosive composition comprising a mixture of ANFO prills and emulsion wherein the ANFO prills comprise a mixture of ammonium nitrate prills and a liquid organic fuel in which a surfactant is dissolved.

11. A blasting composition according to claim 10 wherein the emulsion comprises an organic fuel as a continuous phase, an emulsified inorganic oxidizer salt solution or melt as a discontinuous phase, an emulsifier, and optionally, a density reducing agent.

12. A blasting composition according to claim 11 wherein the emulsifier is selected rom the group consisting of a bis-alkanol amine or bis-polyol derivative of a bis-carboxylated on anhydride derivatized olefinic or vinyl addition polymer, sorbitan fatty esters, glycol esters, substituted oxazolines, alkylamines or their salts, and derivatives thereof.

13. A blasting composition according to claim 10 wherein the surfactant is selected from the group consisting of lecithin; phosphatidylcholine, phosphatidylethanolamine and phosphatidylinositol derivatives; esters; amides; imides; carboxylates; amines; polyamines; alcohols; polyols; ethers and combinations thereof.

14. A blasting composition according to claim 13 wherein the surfactant is present in an amount of from about 2% to about 100% by weight of the liquid organic fuel.

15. A blasting composition according to claim 13 wherein the surfactant is soya lecithin.

16. A blasting composition according to claim 11 wherein the liquid organic fuel is selected from the group consisting of tall oil, mineral oil, waxes, benzene, toluene, xylene, petroleum distillates such as gasoline, kerosene, and diesel fuels, and vegetable oils such as corn oil, cottonseed oil, peanut oil and soybean oil.

17. A blasting composition according to claim 16 wherein the liquid organic fuel is No. 2 fuel oil.

18. A blasting composition according to claim 10 wherein the ammonium nitrate prills contain a clay or talc coating.

19. A stabilized emulsion explosive composition comprising a mixture of emulsion and ANFO prills and further comprising an emulsion in an amount of from about 10% to about 90% by weight of the total composition and ANFO prills in an amount of from about 90% to about 10% and comprised of ammonium nitrate prills in an amount of from about 90% to about 98% by weight of the ANFO prills, a liquid organic fuel in an amount from about 10% to about 2% of the ANFO prills, and a surfactant in an amount of from about 2% to about 30% of the liquid organic fuel and dissolved therein.

20. A stabilized emulsion explosive composition comprising a mixture of emulsion and ammonium nitrate prills wherein the ammonium nitrate prills contain a surfactant which has been added to the prills prior to mixing with the emulsion.

* * * * *